US006861805B2

(12) United States Patent
Jackson et al.

(10) Patent No.: US 6,861,805 B2
(45) Date of Patent: Mar. 1, 2005

(54) COIL ANTENNA/PROTECTION FOR CERAMIC METAL HALIDE LAMPS

(75) Inventors: Andrew D. Jackson, Salina, KS (US); Ray G. Gibson, III, Bath, NY (US); Sarah A. Carleton, Hammondsport, NY (US); Shiming Wu, Painted Post, NY (US); Louis N. Kowalczyk, Alfred Station, NY (US); Thomas Steere, Hornell, NY (US); Jay J. Palmer, Bath, NY (US); John C. Alderman, Corning, NY (US); John E. Conrad, Sr., Bath, NY (US); Kent L. Collins, Hammondsport, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 77 days.

(21) Appl. No.: 09/851,443

(22) Filed: May 8, 2001

(65) Prior Publication Data

US 2002/0185973 A1 Dec. 12, 2002

Related U.S. Application Data

(62) Division of application No. 09/850,960, filed on May 8, 2001.

(51) Int. Cl.[7] ..... H01J 61/06

(52) U.S. Cl. ..... 313/607; 313/594; 315/594; 315/25; 315/47

(58) Field of Search ..... 313/594, 607; 315/594, 47, 25

(56) References Cited

U.S. PATENT DOCUMENTS 3,757,159 A * 9/1973 Gutta et al. ..... 315/47

3,876,895 A * 4/1975 Lake et al. ..... 313/572

(List continued on next page.)

FOREIGN PATENT DOCUMENTS

EP 0549056 A1 6/1993 ..... H01J/61/50

OTHER PUBLICATIONS

Verderber, Rudolph writes the article "Industrial Lightning" in "Wiley Encyclopedia of Electrical and Electronics Engineering Online".*

*Primary Examiner*—Nimeshkumar D. Patel
*Assistant Examiner*—Holly Harper
(74) *Attorney, Agent, or Firm*—Ernestine C. Bartlett

(57) ABSTRACT

The invention relates to a high-pressure discharge lamp of the ceramic metal halide type of the Philips MasterColor series having a molybdenum coil wrapped around the discharge vessel and at least a portion of the electrode feed through means, and having power ranges of about 150 W to about 1000 W. Such lamps are provided with a discharge vessel which encloses a discharge space. The discharge vessel has a ceramic wall and is closed by a ceramic plug. An electrode which is located inside the discharge space is connected to an electric conductor by way of a leadthrough element. The leadthrough element projects through the ceramic plug with a close fit and is connected thereto in a gastight manner by way of a sealing ceramic. The leadthrough element has a first part which is formed by a cermet at the area of the gastight connection. In addition, the lamps display one or more and most preferably all of the following properties: a CCT (correlated color temperature) of about 3800 to about 4500K, a CRI (color rendering index) of about 70 to about 95, a MPCD (mean perceptible color difference) of about ±10, and a luminous efficacy up to about 85–95 lumens/watt, a lumen maintenance of >80%, color temperature shift <200K from 100 to 8000, and lifetime of about 10,000 hours to about 25,000 hours. The invention also relates to design spaces for the design and construction of high power lamps and methods for construction of such lamps using the design spaces.

16 Claims, 11 Drawing Sheets

U.S. PATENT DOCUMENTS

| | | | | | |
|---|---|---|---|---|---|
| 4,179,640 | A | | 12/1979 | Larson et al. | 315/47 |
| 4,491,766 | A | | 1/1985 | Larson | 315/60 |
| 4,742,269 | A | * | 5/1988 | Izumiya et al. | 313/624 |
| 4,950,938 | A | | 8/1990 | Ramaiah | 313/25 |
| 4,983,889 | A | * | 1/1991 | Roberts | 315/246 |
| 5,382,873 | A | * | 1/1995 | Scholl et al. | 313/570 |
| 5,438,235 | A | * | 8/1995 | Sommerer et al. | 313/489 |
| 5,604,410 | A | * | 2/1997 | Vollkommer et al. | 315/246 |
| 5,637,960 | A | * | 6/1997 | Juengst et al. | 313/625 |
| 6,172,462 | B1 | * | 1/2001 | Gibson et al. | 313/594 |
| 6,326,721 | B1 | * | 12/2001 | Shippee et al. | 313/283 |
| 6,400,076 | B1 | * | 6/2002 | Allen et al. | 313/572 |
| 6,465,940 | B1 | * | 10/2002 | Ikeuchi et al. | 313/283 |
| 6,501,220 | B1 | * | 12/2002 | Lambrechts et al. | 313/571 |

* cited by examiner

COIL ANTENNA/PROTECTION FOR CERAMIC METAL HALIDE LAMPS

RELATED APPLICATION

This application is a divisional application of our U.S. Ser. No. 09/850,960 filed May 8, 2001, for "150 W–1000 W MasterColor® Ceramic Metal Halide Lamp Series with Color Temperature about 4000K, for High Pressure Sodium or Quartz Metal Halide Retrofit Applications."

FIELD OF THE INVENTION

The invention relates to a high-pressure discharge lamp which is provided with a discharge vessel that encloses a discharge space and includes a ceramic wall, the discharge space accommodating an electrode which is connected to an electric current conductor by means of a leadthrough element. The invention also relates to a high intensity discharge (HID) lamp having a discharge vessel light source, a glass stem, a pair of leads embedded in the glass stem, a glass envelope surrounding the light source, and a wire frame member with a first end fixed with respect to the stem, an axial portion extending parallel to the axis of the lamp, and a second end resiliently fitted in the closed end of the glass envelope.

BACKGROUND OF THE INVENTION

High intensity discharge (HID) lamps are commonly used in large area lighting applications, due to their high energy efficiency and superb long life. The existing HID product range consists of mercury vapor (MV), high pressure sodium (HPS), and quartz metal halide (MH) lamps. In recent years, ceramic metal halide lamps (for example, Philips MasterColor® series) have entered the market place. Compared to the conventional HID lamps, the ceramic metal halide lamps display excellent initial color consistency, superb stability over life (lumen maintenance >80%, color temperature shift <200K at 10,000 hrs), high luminous efficacy of >90 lumens/watt and a lifetime of about 20,000 hours. These highly desirable characteristics are due to the high stability of the polycrystalline alumina (PCA) envelopes and a special mixture of salts, which emits a continuous-spectrum light radiation close to natural light.

The salt mixture used in Philips MasterColor® series lamps is composed of NaI, $CaI_2$, TlI, and rare-earth halides of $DyI_3$, $HoI_3$ and $TmI_3$. NaI, $CaI_2$ and TlI are mainly for emitting high intensity line radiation at various colors, but they also contribute to continuous radiation. The rare-earth halides are for continuous radiation throughout the visible range, resulting in a high color rendering index (CRI). By adjusting the composition of the salts, color temperatures of 3800–4500K, and a CRI of above 85 can be achieved. The existing power range of such lamps is from 20 W to 150 W. The relatively narrow power range makes these products only suitable for the applications requiring low power installations, such as most indoor low-ceiling retail spaces. For large area, higher power applications requiring a lamp power of 200 W to 1000 W, the primary available products are MV, HPS and MH lamps. Simply scaling up the dimensions of the low power arc tubes to the higher power arc tubes results in a design with high thermomechanical stresses that limit the lifetime of the lamps to an unacceptable level.

One example of a lamp of the kind set forth is known from U.S. Pat. No. 5,424,609. The known lamp has a comparatively low power of 150 W at the most at an arc voltage of approximately 90 V. Because the electrode in such a lamp conducts comparatively small currents during operation of the lamp, the dimensions of the electrode may remain comparatively small so that a comparatively small internal diameter of the projecting plug suffices. In the case of a lamp having a rated power in excess of 150 W, or a substantially lower arc voltage, for example as in the case of large electrode currents, electrodes of larger dimensions are required. Consequently, the internal plug diameter will be larger accordingly. It has been found that in such lamps there is an increased risk of premature failure, for example due to breaking off of the electrode or cracking of the plug.

Protected pulse-start metal halide lamps (with both low-wattage ceramic arc tubes and low/high wattage quartz arc tubes) use a quartz sleeve and often a Mo coil wrapped around the sleeve to contain particles within the outer bulb in the event of an arc tube rupture. These lamps do not require auxiliary antenna to aid the ignition process.

Other lamps such as HPS or sodium halide lamps use a refractory metal spiral to aid in starting and to inhibit sodium migration through the arc tube during operation. Representative of such uses are:

EP 0549056 which discloses a metal coil used for containment only and not for ignition. In addition, the coil is wrapped around a sleeve that surrounds the arc tube and is not wrapped around the arc tube itself.

U.S. Pat. No. 4,179,640 which discloses a coil used for ignition only in HPS lamps and not for containment. In addition, the coil is electrically connected to the frame wire and is not capacitively coupled.

U.S. Pat. No. 4,491,766 which discloses a coil used for ignition and inhibition of sodium migration and not for containment. In addition, the coil is electrically connected to the frame wire and is not capacitively coupled. U.S. Pat. No. 4,950,938 discloses a metal screen and not a coil, the screen is used for containment only and not for ignition.

There is a need in the art for HID lamps of the ceramic metal halide type with power ranges of about 150 W to about 1000 W, and for such lamps that use a metal coil for both ignition and containment.

SUMMARY OF THE INVENTION

An object of the invention is to provide HID lamps of the ceramic metal halide type with power ranges of about 150 W to about 1000 W that use a metal coil wound around the arc tube of such lamps for both ignition and containment. The nominal voltage, as specified by applicable ANSI standards for HPS and MH varies from 100V to 135V for 150 W to 400 W lamps and then increases with the rated power to about 260V for 1000 W lamps.

Another object of the invention is to provide ceramic metal halide lamps of the Philips MasterColor® series that display excellent initial color consistency, superb stability over life (lumen maintenance >80%, color temperature shift <200K at 10,000 hrs), high luminous efficacy of >90 lumens/watt, a lifetime of about 20,000 hours, and power ranges of about 150 W to about 1000 W that use a metal coil wound around the arc tube for both ignition and containment.

Another object is to provide a way to mitigate the drawbacks and risks of failure discussed above.

These and other objects of the invention are accomplished, according to a first embodiment of the invention in which an entire product family of gas discharge lamps with rated power of 150 W to 1000 W and that use a metal coil wound around the arc tube of such lamps for both ignition and containment are provided which may be coupled with ANSI standard series of ballasts designed for high pressure sodium or quartz metal halide lamps (pulse-start or switch-start). The lamps of the invention are an extension of Philips MasterColor® series lamps to a power range of 150 W to 1000 W, and they are suitable for same-power HPS or MH retrofit. Therefore, they may be used with most existing ballast and fixture systems.

In its preferred embodiments, the invention provides ceramic metal halide lamps having a power range of about 150 W to about 1000 W, that use a metal coil wound around the arc tube for both ignition and containment and are suitable for high pressure sodium and/or quartz metal halide retrofit.

In another preferred embodiment, such high power lamps as described above will have one or more and most preferably all of the following properties: a CCT (correlated color temperature) of about 3800 to about 4500K, a CRI (color rendering index) of about 70 to about 95, a MPCD (mean perceptible color difference) of about ±10, and a luminous efficacy up to about 85–95 lumens/watt.

In another preferred embodiment, ceramic metal halide lamps are provided which have been found, regardless of the rated power, to have a lumen maintenance of >80%, color temperature shift <200K from 100 to 8000 hours, and lifetime of about 10,000 to about 25,000 hours.

Especially preferred are ceramic metal halide lamps that display excellent initial color consistency, superb stability over life (lumen maintenance >80%, color temperature shift <200K at 10,000 hrs), high luminous efficacy of >90 lumens/watt, a lifetime of about 20,000 hours, and power ranges of about 150 W to about 1000 W.

The invention also provides novel design spaces containing parameters for any lamp power between about 150 W and 1000 W in which appropriate parameters for the body design of a lamp operable at the desired power is obtained by selection from parameters in which (i) the arc tube length, diameter and wall thickness limits are correlated to and expressed as functions of lamp power, and/or color temperature, and/or lamp voltage, and (ii) the electrode feedthrough structure used to conduct electrical currents with minimized thermal stress on the arc tube are correlated to and expressed as a function of lamp current. The invention also provides methods for producing ceramic metal halide lamps having predetermined properties through use of the design spaces of the invention.

BRIEF DESCRIPTION OF THE DRAWINGS

The above aspects and further aspects of the lamps in accordance with the invention will be described in detail hereinafter with reference to the drawing in which.

The invention will be better understood with reference to the details of specific embodiments that follow:

DETAILED DESCRIPTION OF THE PREFERRED EMBODIMENTS

Figure 8:
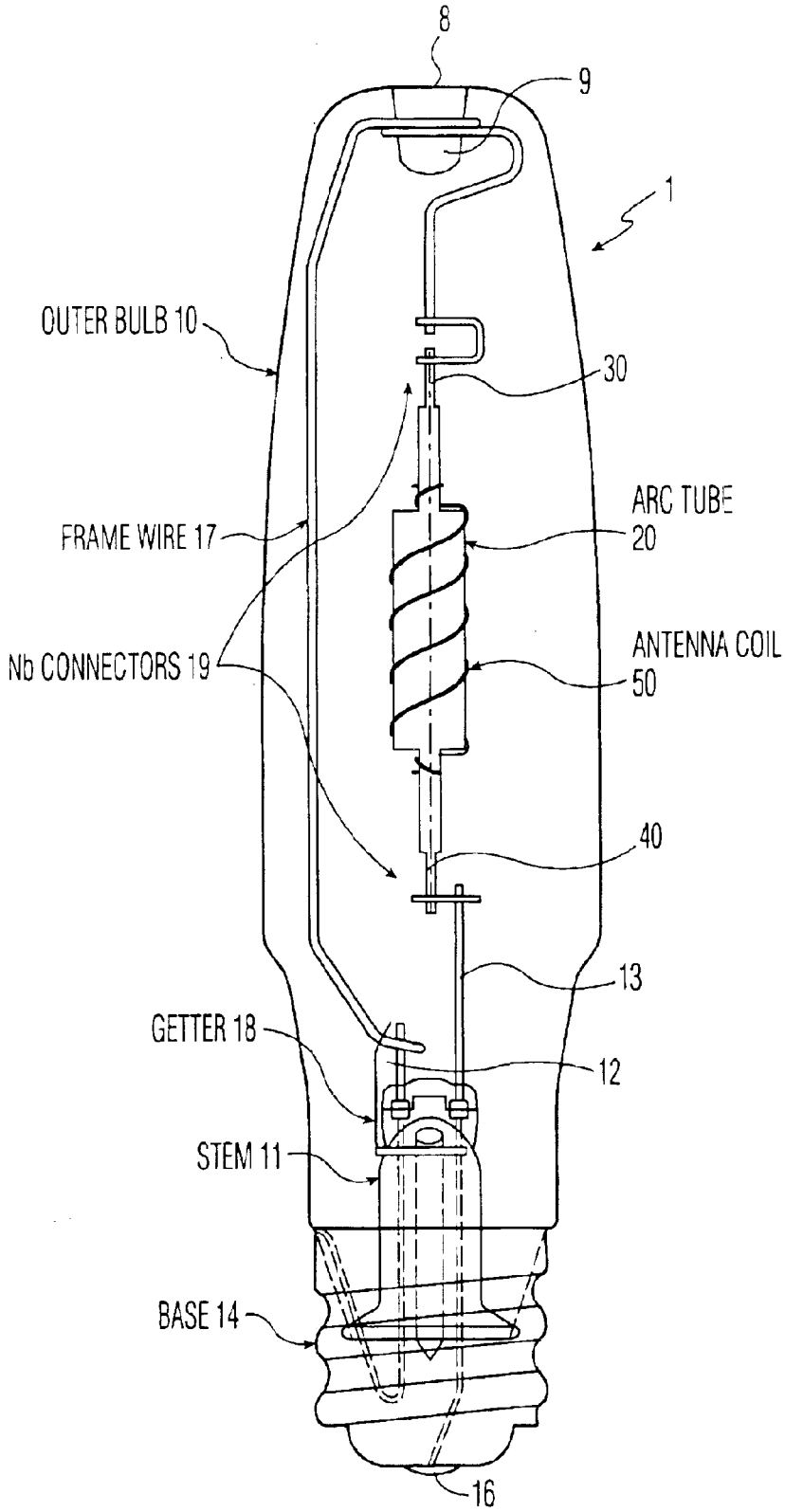
FIG. 8 is a schematic of a lamp according to a preferred embodiment of the invention.

Referring to FIG. 8, a ceramic metal halide discharge lamp 1 comprises a glass outer envelope 10, a glass stem 11 having a pair of conductive frame wires 12, 13 embedded therein, a metal base 14, and a center contact 16 which is insulated from the base 14. The stem leads 12, 13 are connected to the base 14 and center contact 16, respectively, and not only support the arc tube 20 but supply current to the electrodes 30, 40 via frame wire member 17 and stem lead member 13. A getter 18 is fixed to the frame wire member 17. Niobium connectors 19 provide an electrical connection for the arc tube electrode feedthroughs 30 and 40. Beyond this the frame member 17 is provided with an end portion 9 that contacts a dimple 8 formed in the upper axial end of the glass envelope 10.

Figure 9:
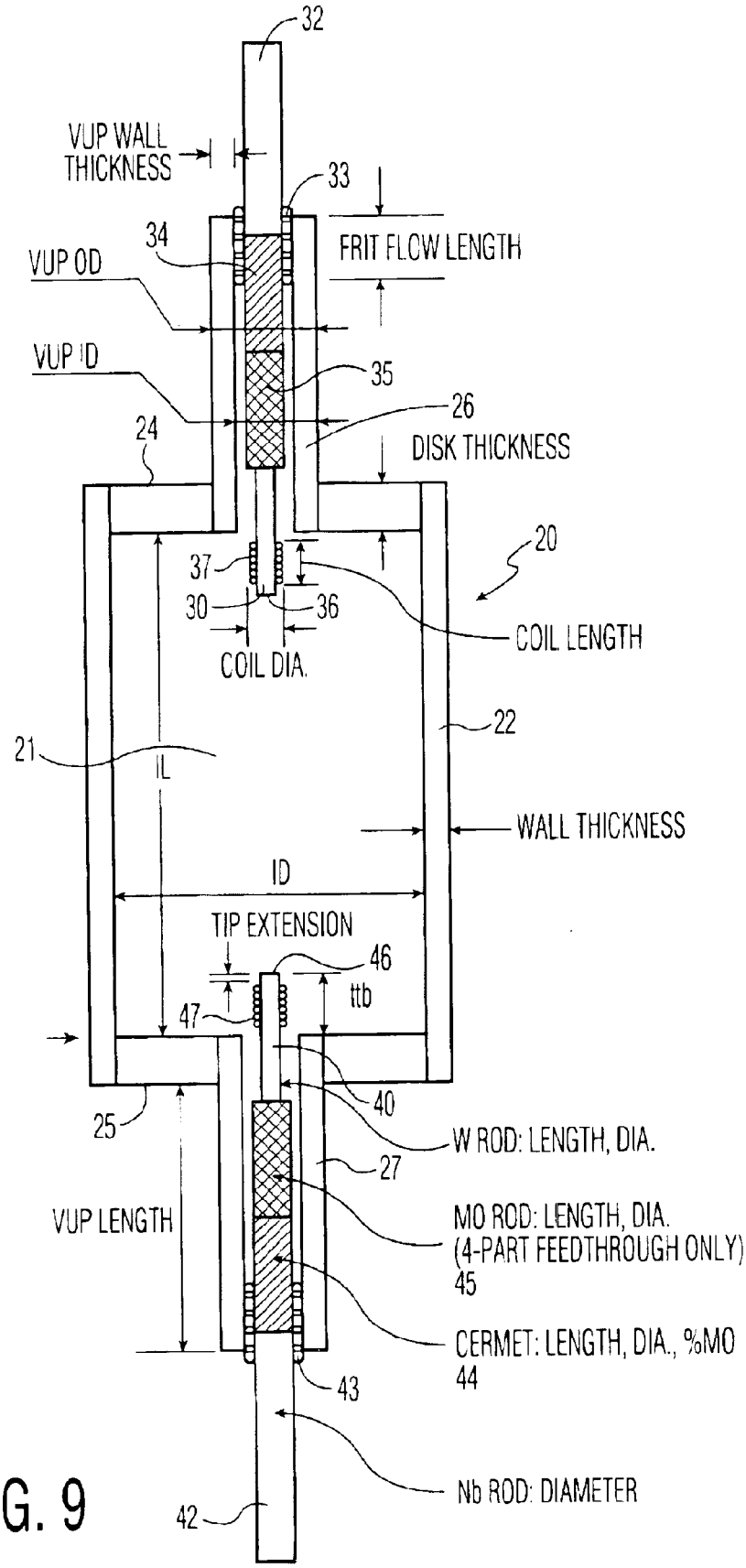
FIG. 9 is a sectional view of a ceramic arc tube of FIG. 8 according to a preferred form of the invention.

FIG. 9 shows a preferred embodiment of the arc tube 20 having a four-part feedthrough in cross-section. The central barrel 22 is formed as a ceramic tube having disc-like end walls 24, 25 with central apertures which receive end plugs 26, 27. The end plugs are also formed as ceramic tubes, and receive electrodes 30, 40 therethrough. The electrodes 30, 40 each have a lead-in 32, 42 of niobium which is sealed with a frit 33, 43 which hermetically seals the electrode assembly into the PCA arc tube, a central portion 34, 44 of molybdenum/aluminum cermet, a molybdenum rod portion 35, 45 and a tungsten rod 36, 46 having a winding 37, 47 of tungsten. The barrel 22 and end walls 24, 25 enclose a discharge space 21 containing an ionizable filling of an inert gas, a metal halide, and mercury.

Figure 10:
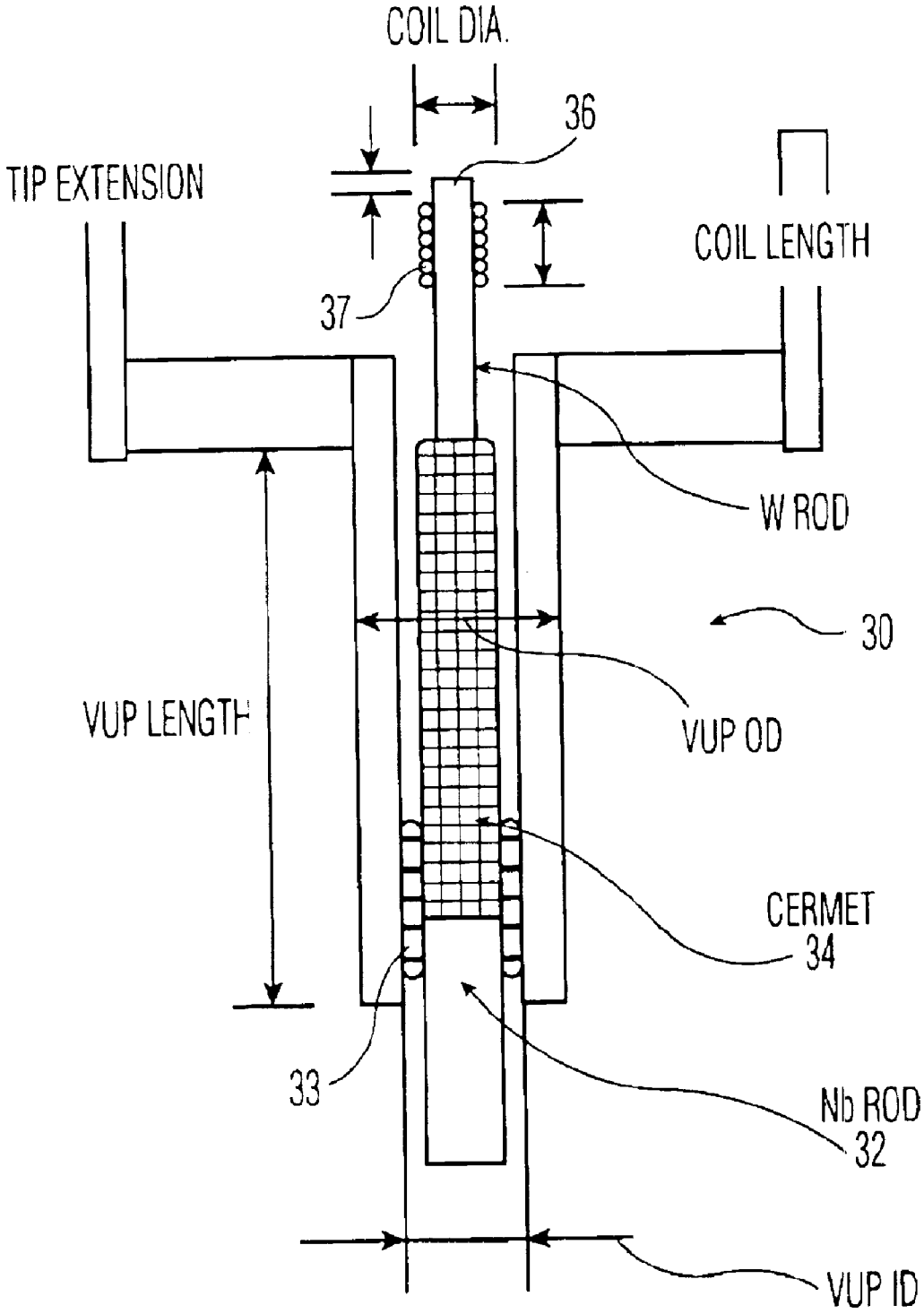
FIG. 10 is a sectional view of a three-part electrode feedthrough of FIG. 8 according to a preferred form of the invention.
Figure 11A:
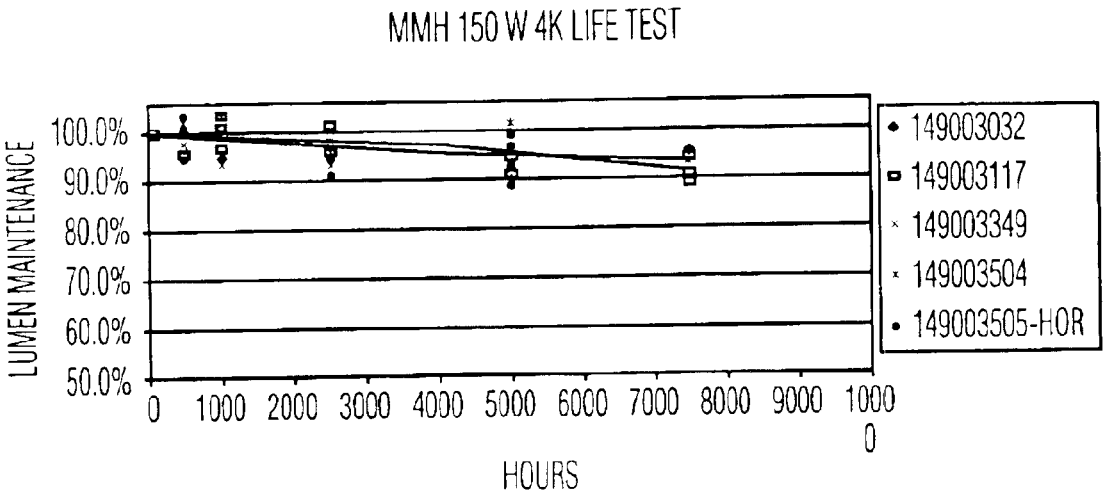
FIG. 11 is a graph of lumen maintenance 150 W and 200 W lamps according to a preferred form of the invention.
Figure 11B:
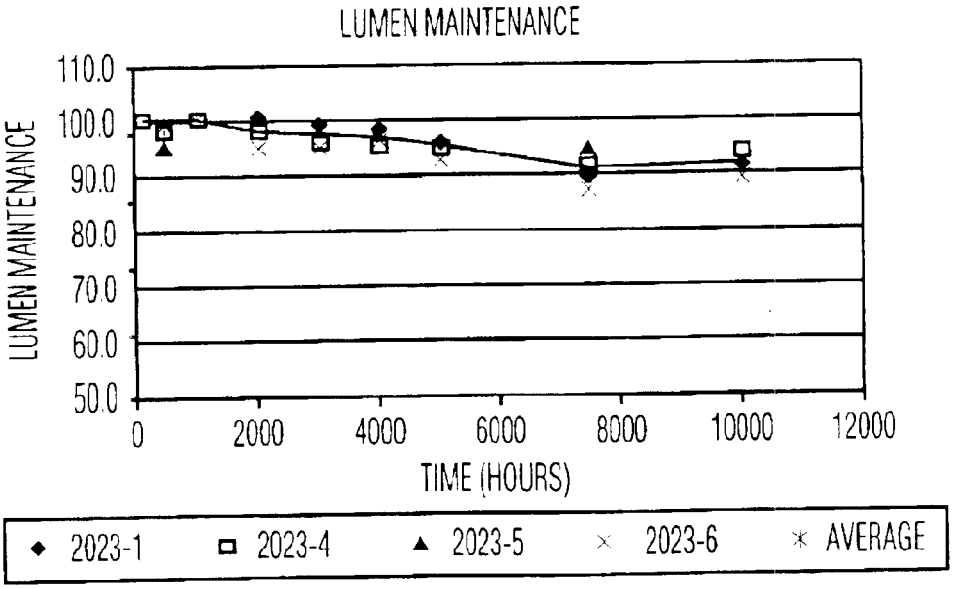

FIG. 10 shows a second preferred embodiment of the arc tube 20 having a three-part feedthrough in cross-section. The electrodes 30, 40 (only 30 is illustrated) each have a lead-in 32, 42 of niobium which is sealed with a frit 33, 43, a central portion 34, 44 of molybdenum or cermet, and a tungsten rod 36, 46 having a winding 37, 47 of tungsten.

As used herein, "ceramic" means a refractory material such as a monocrystalline metal oxide (e.g. sapphire), polycrystalline metal oxide (e.g. polycrystalline densely sintered aluminum oxide and yttrium oxide), and polycrystalline non-oxide material (e.g. aluminum nitride). Such materials allow for wall temperatures of 1500–1600K and resist chemical attacks by halides and Na. For purposes of the present invention, polycrystalline aluminum oxide (PCA) has been found to be most suitable.

FIG. 8 also shows a ceramic metal halide arc tube 20 having a conductive antenna coil 50 extending along the length of barrel 22 and wrapped around the arc tube 20 and around the extended plugs 26,27. The antenna coil 50 reduces the breakdown voltage at which the fill gas ionizes by a capacitive coupling between the coil and the adjacent lead-in in the plug. When an AC voltage is applied across the electrodes, the antenna stimulates stimulates UV emission in the PCA, which in turn causes primary electrons to be emitted by the electrode. The presence of these primary electrons hastens ignition of a discharge in the fill gas.

A designed experiment was carried out to determine the effect of gas type, gas pressure, and antenna type on various characteristics of MMH 200 W lamps. Gas type was varied on two levels (Ar and Xe); gas pressure was varied on two levels (100 and 200 torr); antenna type was varied on three levels (graphite applied to arc tube, Mo coil wrapped around arc tube, and Mo wire/bimetal). The PCA tube dimensions were ID=7.4 mm, IL=26 mm, $t_{wall}$=0.95 mm. The electrodes were 3-piece cermet assemblies with W rod length of 4 mm and rod diameter of 0.500 mm. The ttb distance was set to 2.0 mm. Salts were 15 mg of 14% NaI, 7% TlI, 12% $DyI_3$, 12% $HoI_3$, 12% $TmI_3$ and 43% $CaI_2$. Arc tubes were mounted in lamps and tested. No UV enhancers were included in the lamps (and no Kr85 was included in the arc tubes). Antenna type was varied on three levels—graphite applied to arc tube (capacitively coupled), Mo coil wrapped around arc tube (capacitively coupled), and Mo wire/bimetal (attached to the long lead wire). The responses included ignition characteristics at 1 h, arc tube temperatures and containment at 100 h, and photometric characteristics at 100 and 800 h.

Several lamps were produced using Xenon and argon and were subjected to ANSI test protocol method for measurement for containment testing of quartz metal halide lamps to be published as an appendix to American National Standard for method of measurement of metal halide lamps, ANSI C78.387–1995. Due to the limited number of lamps, only one sample from each test was submitted for the containment test. All lamps contained the ruptured arc tube fragments within the outer bulb except one (from the test with 200-torr Ar and Mo wire antenna), which had a hole in the outer bulb less than 1 $cm^2$. According to the ANSI test protocol, this design could be re-tested before failing the containment test. The arc tubes generally ruptured into a few pieces, but the arc tubes in the lamps with the Mo coil design showed the least movement. The differences among the three types of antennas used for these tests were relatively slight in terms of their function as an ignition aid. However, the Mo coil antenna alone served a dual function as containment protection and ignition.

By "containment" is meant the prevention of outer bulb damage caused by arc tube rupture.

The Mo used for the coil preferably is potassium-doped and is designated HCT (high crystallization temperature). This material must withstand vacuum firing at 1300° C. and then show no cracking, splitting, delamination, or splintering when submitted to an ASTM ductility test. Even if Mo does recrystallize, it remains ductile at temperatures over about 100° C., and the elastic strength remains above 100 MPa up to about 1200° C.

Thus to summarize, there is provided high wattage discharge lamps which comprise a ceramic discharge vessel which encloses a discharge space and is provided with preferably a cylindrical-shaped ceramic, preferably a sintered translucent polycrystalline alumina arc tube with electrodes, preferably tungsten-molybdenum-cermet-niobium electrodes or tungsten-cermet-niobium electrodes, attached on either side by gas-tight seals. Metallic mercury, a mixture of noble gases and radioactive $^{85}Kr$, and a salt mixture composed of sodium iodide, calcium iodide, thallium iodide and several rare earth iodides are contained in the arc tube. The arc tube is protected from explosion by a molybdenum coil, which also serves as antenna for starting. The entire arc tube and its supporting structure are enclosed in a standard-size lead-free hard glass bulb, with other components such as a getter (18 in FIG. 8) or an UV enhancer (not shown) attached as necessary.

In preferred embodiments of the invention, the following design parameters have been found to mitigate and in most cases eliminate the effects of higher thermal stress associated with the higher lamp powers. We have found the parameters to be especially suitable for the production of lamp products of 150 W to 400 W of power and 100V of lamp voltage, and with modifications in some of the design parameters, lamps with 135V–260V voltage and/or higher powers (up to 1000 W) may also be designed. These design parameters are:

(i) the general aspect ratio, i.e. the ratio of the inner length (IL) to the inner diameter (ID) of the PCA arc tube body is higher than that of low power-range MasterColor® lamps.

(ii) general design spaces for any lamp power between 150 W and 1000 W, in terms of arc tube length, diameter and wall thickness limits, are expressed as functions of lamp power, color temperature, and lamp voltage and the upper and lower limits of such parameters are determined for the selected lamp powers and a method is provided for selecting parameters from the design space to provide a lamp with previously selected characteristics.

(iii) a unique laser-welded Tungsten-cermet-Niobium or tungsten-molybdenum-cermet-niobium electrode feedthrough structure is used to conduct large electrical currents with minimized thermal stress on the PCA.

(iv) the design parameter limits of such feedthroughs are given as the function of lamp current.

(v) for reducing the risk of non-passive failure, a molybdenum coil wrapped around the arc tube and around the extended plugs is used.

(vi) the salt composition is adjusted, to the desired color temperatures, for the geometry and varying lamp voltages of the high power MasterColor® lamps. A general composition range of the salts is given as the function of color temperature and lamp voltage.

(vii) the starting characteristics of the lamps are accomplished by using a mixture of Xenon, Argon, Krypton and $^{85}Kr$ gases.

Referring to FIGS. 1 to 7 and 11, the above design parameters may be categorized as including one or more of the following:

(1) Design space limits for arc tube geometry;

(2) Electrode feedthrough construction and design limits;

(3) Composition range of iodide salts for achieving desired photometric properties (CCT=3800–4500K, CRI=85–95, MPCD=±10, luminous efficacy of 85–95 lumens/watt); and (4) Buffer gas composition and pressure range.

An especially important aspect of the invention lies in the discovery of the parameter limits within which the whole product family having a power of 150 W to 1000 W, regardless of the specific rated power, has a lumen maintenance of >80% at 8000 hours (see FIG. 11 for an example); color temperature shift <200K from 100 hours to 8000 hours; and a lifetime in a range of 10,000 hours to 25,000 hours.

Design Space for Arc Tube Geometry

Figure 1:
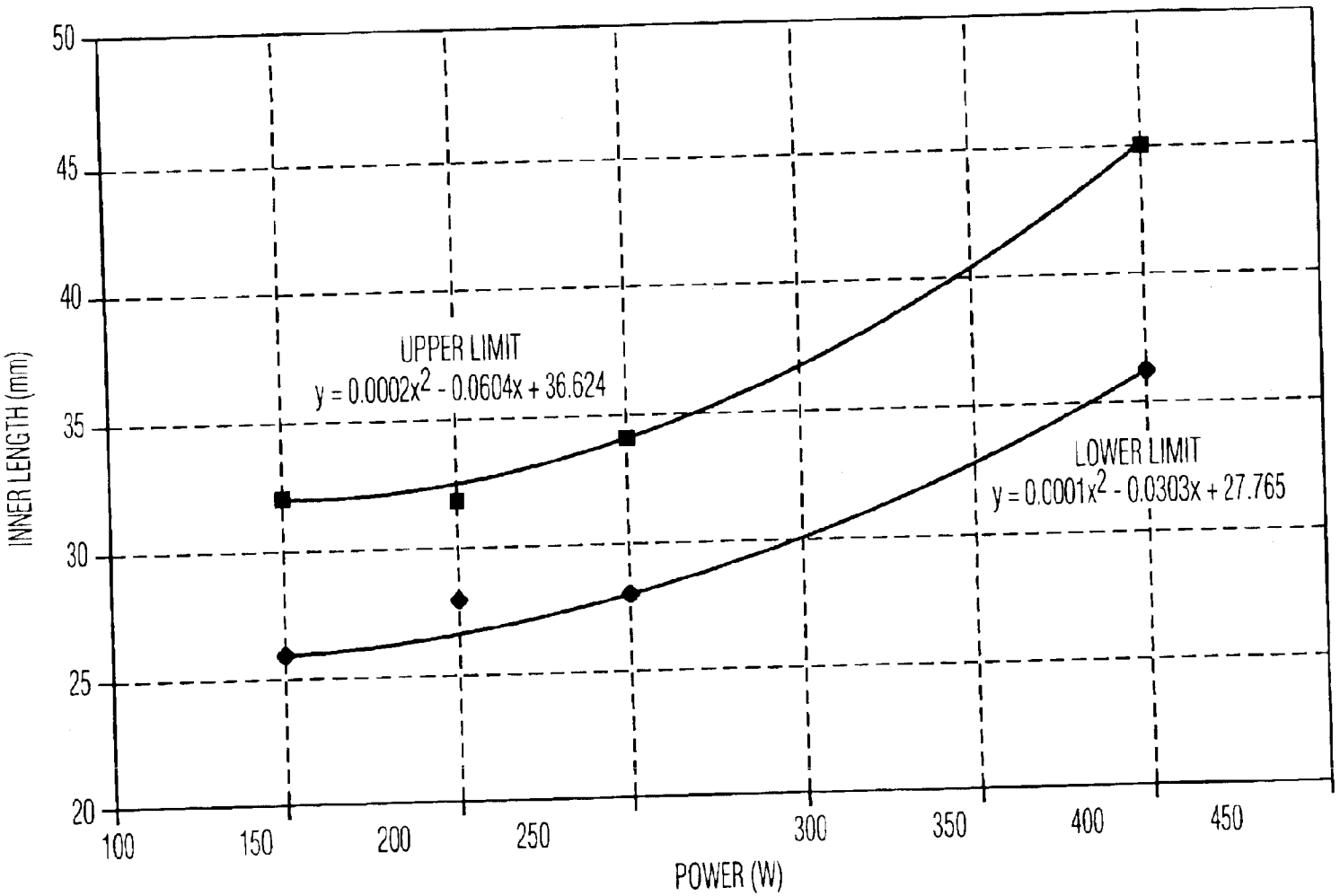
FIG. 1 is a graph illustrating a range of upper and lower limits for the dimensions of the arc tube inner length in a preferred embodiment of the invention.
Figure 2:
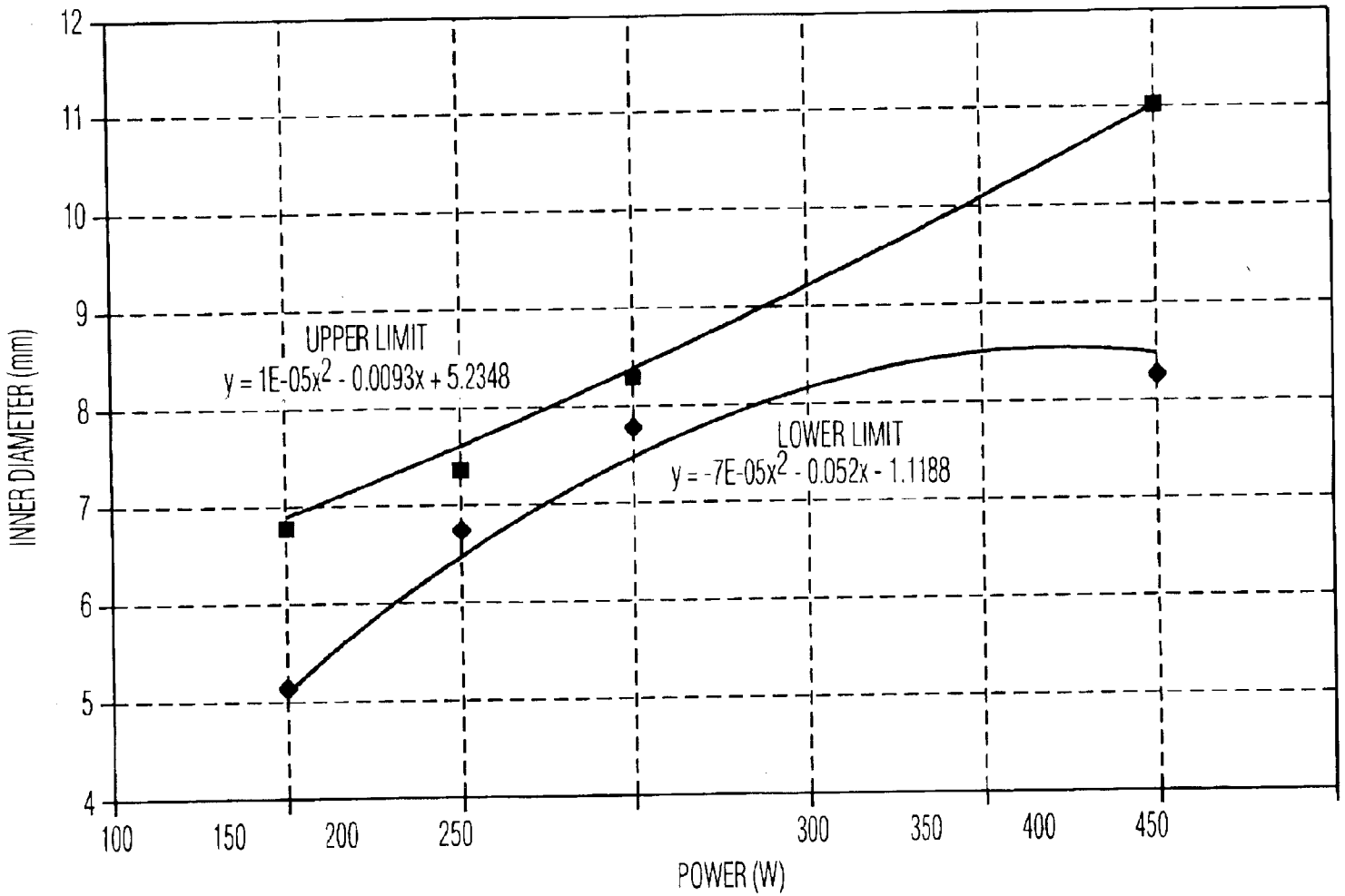
FIG. 2 is a graph illustrating a range of upper and lower limits for the dimensions of the arc tube inner diameter in a preferred embodiment of the invention.

The arc tube geometry is defined by a set of parameters best illustrated in FIGS. 1 to 5 and FIG. 9 which also illustrates major parameters used. As seen in FIGS. 1 and 9, the arc tube body inner length (IL) is determined by lamp power. The upper and lower limit of IL for any given lamp power between 150 W and 400 W can be found in FIG. 1. The arc tube body inner diameter (ID) is also a function of lamp power. The upper and lower limits of the ID for any given lamp power from 150 W to 400 W are shown in FIG. 2.

Figure 3:
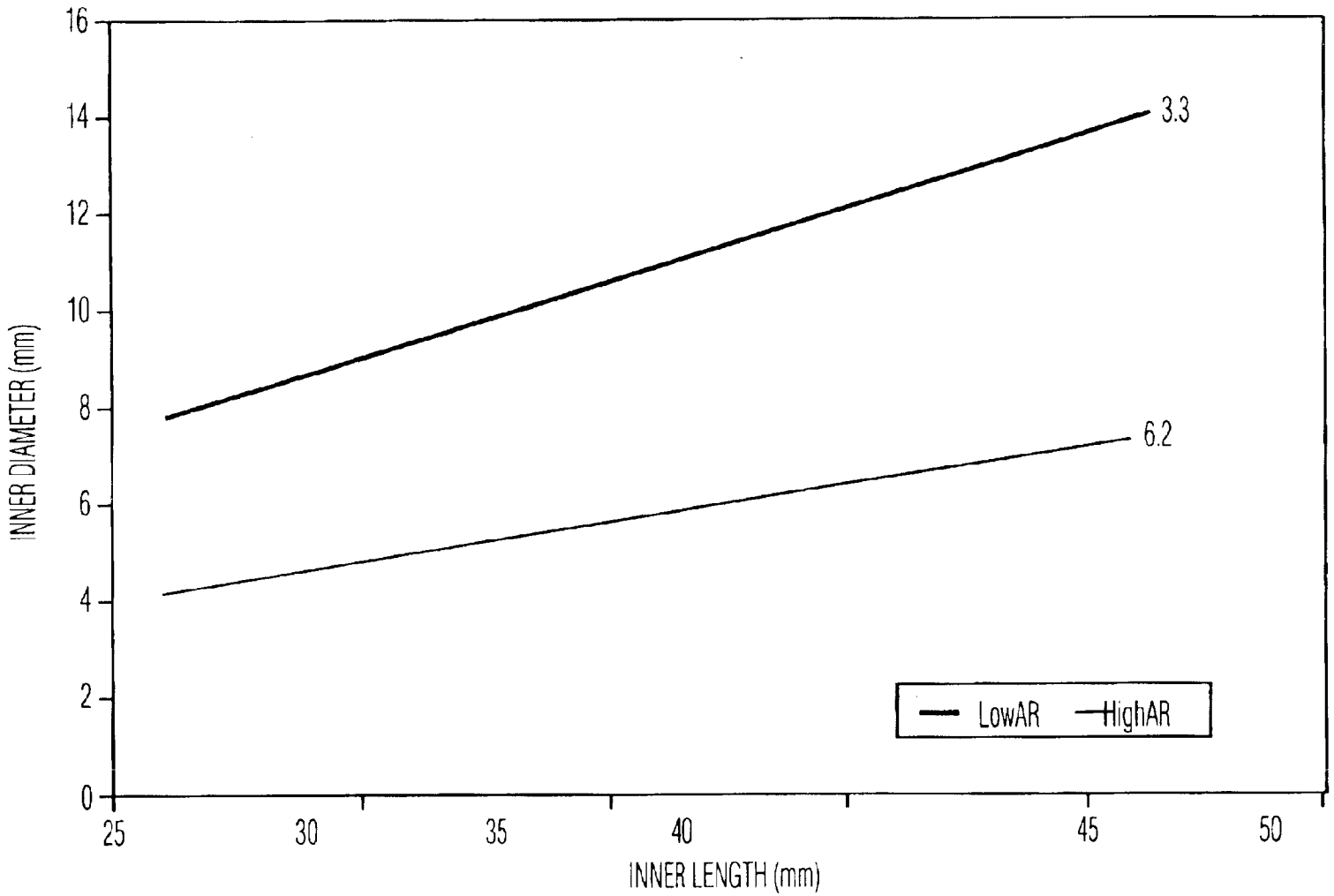
FIG. 3 is a graph illustrating a design space of the limits of aspect ratio in a preferred embodiment of the invention.

One of the common characteristics of this higher wattage MasterColor® lamp family is that the aspect ratio of the arc tube body is higher than that of the lower wattage MasterColor lamps (30–150 W). The aspect ratio of the arc tube body of lower wattage lamps is about 1.0–1.5. For any given lamp power for the lamps of the present invention, the aspect ratio (IL/ID) falls into a range of 3.3–6.2. The geometric design space is shown in an IL-ID plot in FIG. 3. The shaded space shown in FIG. 3 is the general design space which does not specify lamp power.

Figure 4:
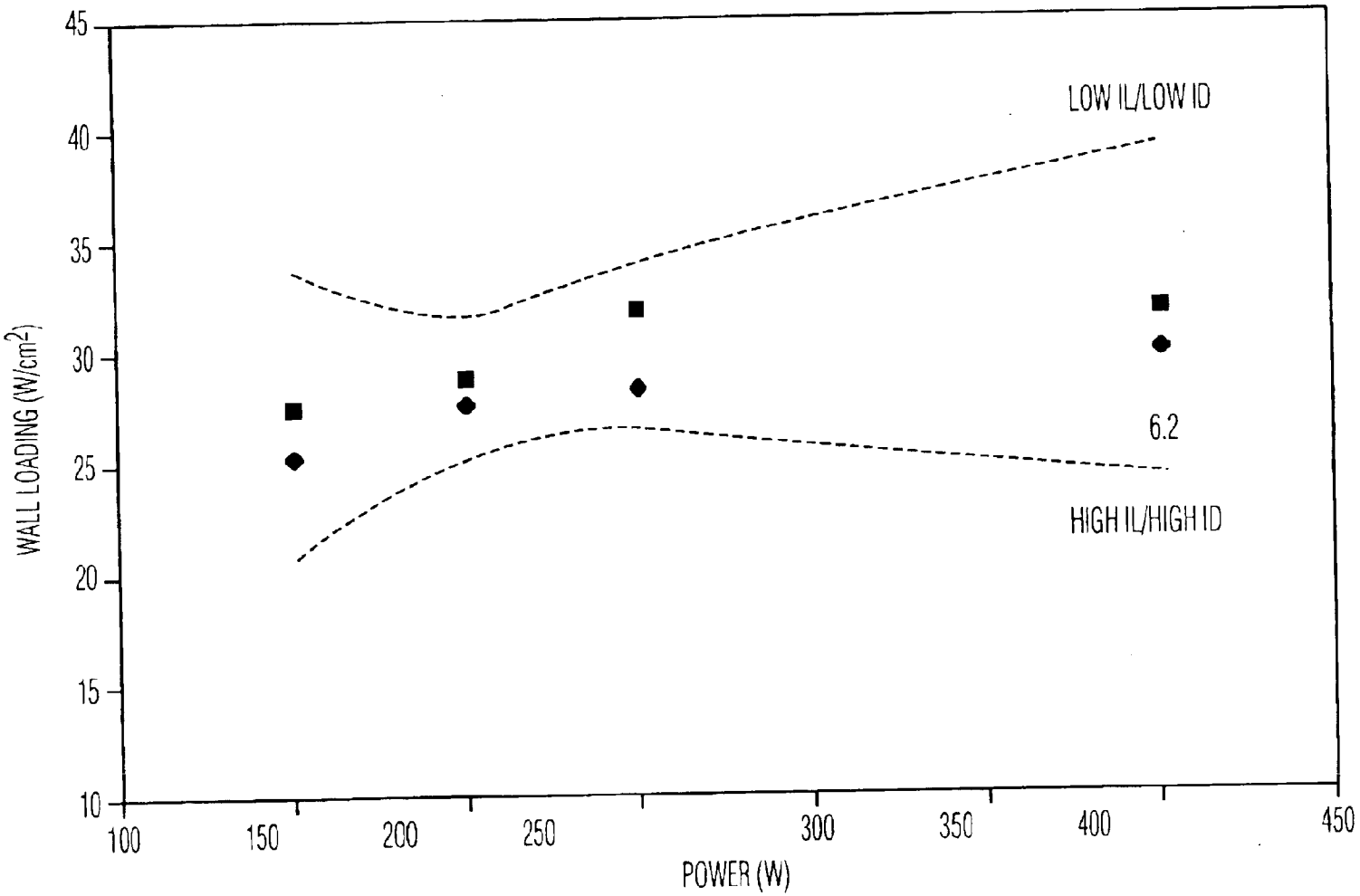
FIG. 4 is a graph illustrating a design space of wall loading versus power in a preferred embodiment of the invention.
Figure 5:
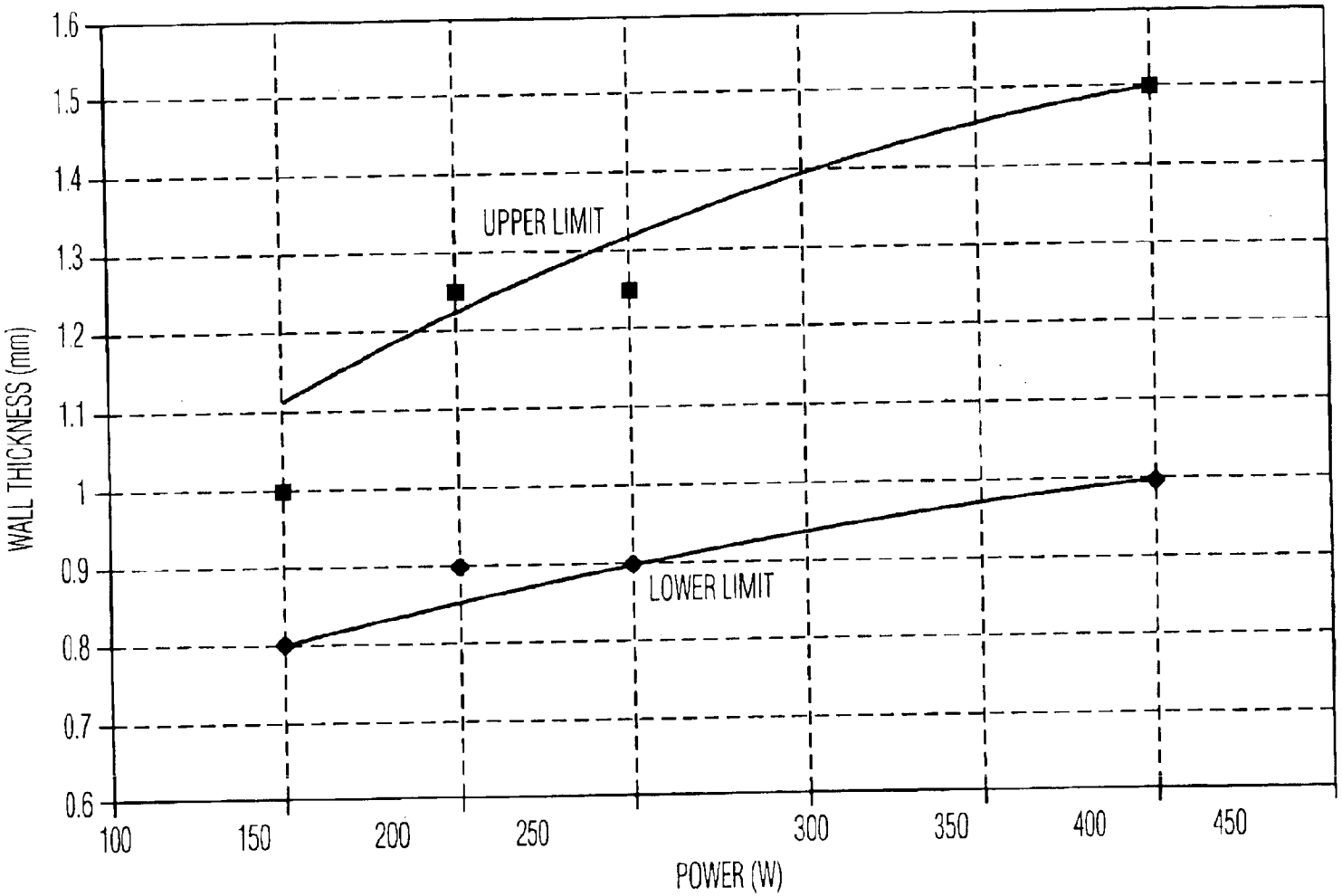
FIG. 5 is a graph illustrating a range of upper and lower limits for the dimensions of the arc tube wall thickness versus the lamp power in a preferred embodiment of the invention.

How each design is compared with others of different rated powers is measured by "wall loading". Wall loading is defined as the ratio of power and the inner surface area of arc tube body, in a unit of $W/cm^2$. In FIG. 4, the upper line is the wall loading value as if the IL and ID are both at their lower limits for the power, therefore the inner surface area is the minimum and wall loading is at maximum. The lower line is the wall loading level as if both IL and ID are at upper limits, making the surface area the maximum and wall loading minimum. Any other designs should have a wall loading range between 23–35 $W/cm^2$, as indicated by the individual points inside the shaded area. Across the power range of 150 W to 400 W, the wall loading level remains fairly constant.

Generally, arc tubes for higher lamp power require a thicker wall, in accordance with the larger volume. The limits of the wall thickness are specified in FIG. 5.

Electrode Feedthrough Construction and Design Parameters

Electrodes for conducting current and acting alternatively as cathode and anode for an arc discharge are constructed specifically for the ceramic arc tubes. FIGS. 9 and 10 give the details of the components and their relative positions in the arc tube and show the preferred embodiments of the arc tube 20 having a four-part and a three-part feedthrough, respectively, in which electrodes 30, 40 each have a lead-in 32, 42 of niobium which is sealed with a frit 33, 43, a central portion 34, 44 of molybdenum/aluminum cermet, a molybdenum rod portion 35, 45 and a tungsten tip (rod) 36, 46 having a winding 37, 47 of tungsten and/or in which electrodes 30, 40 each have a lead-in 32, 42 of niobium which is sealed with a frit 33, 43, a central portion 34, 44 of molybdenum/aluminum cermet, and a tungsten tip (rod) 36, 46 having a winding 37, 47 of tungsten. Preferably, each joint connecting two feedthrough components is welded by a laser welder. Although the three-part feedthrough structure is similar to those used in the lower wattage MasterColor® lamps, the preferred design parameters for constructing the feedthroughs for larger current are given here.

Figure 6:
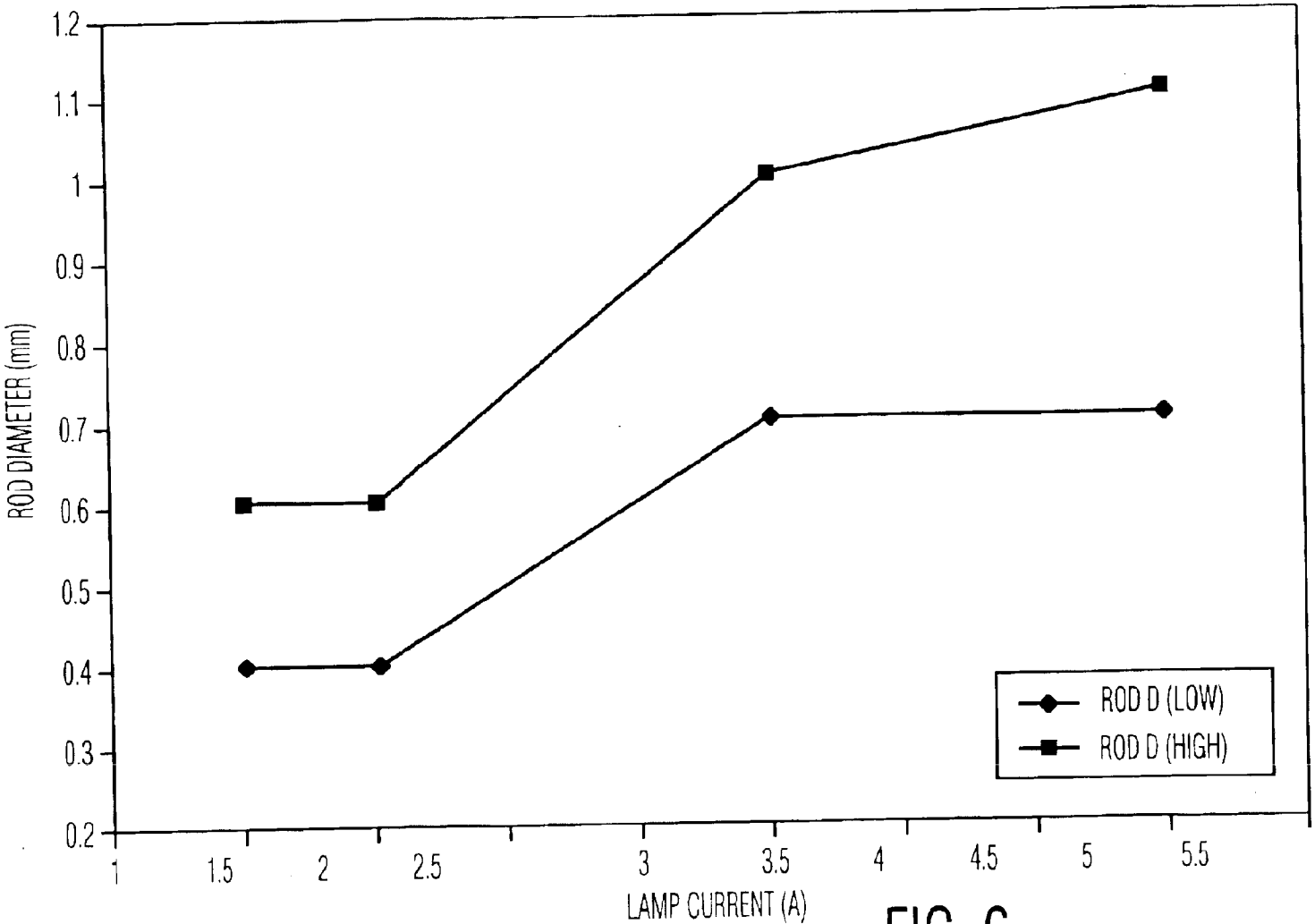
FIG. 6 is a graph illustrating a range of upper and lower limits for electrode rod diameter versus power in a preferred embodiment of the invention.
Figure 7:
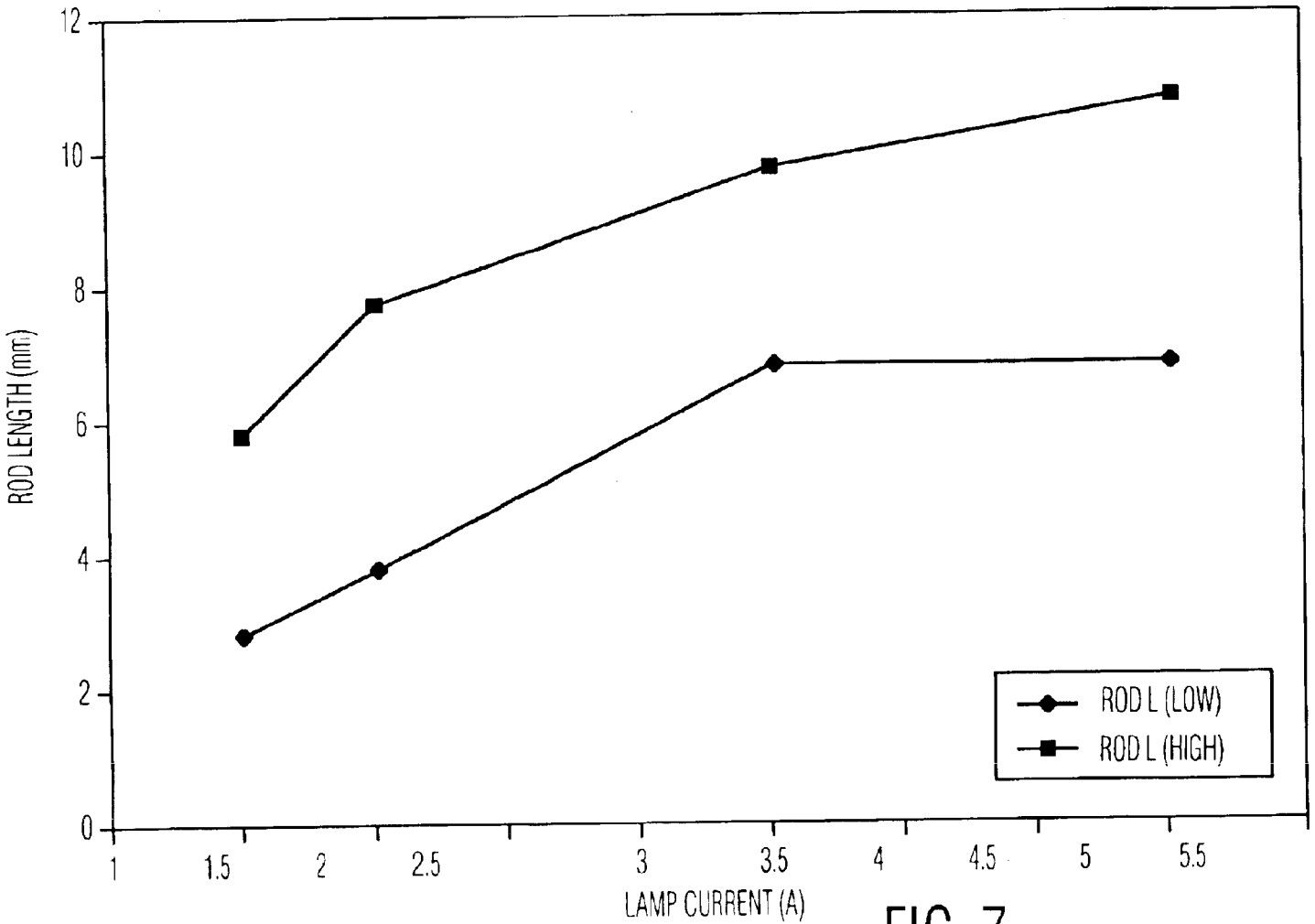
FIG. 7 is a graph illustrating a range of upper and lower limits for electrode rod lengths versus power in a preferred embodiment of the invention.

The primary design parameters for feedthroughs include electrode rod diameter and length as illustrated in FIGS. 6 and 7 which indicate the limits for rod diameter and rod length, versus lamp power.

Preferably additional parameters are present for the preferred embodiments of the feedthrough construction and include (1) the tip extension of the electrode is in the range of 0.2–1.0 mm, (2) the tip-to-bottom (ttb) distance, ie. the length of electrode inside the arc tube body, is in a range of 1 mm to 4 mm and generally increases with power, (3) cermet should contain no less then about 35 wt. % Mo, with a preferred Mo content of no less than about 55 wt. % with the remainder being $Al_2O_3$, (4) the frit (also known as sealing ceramic) flow should completely cover the Nb rod, and (5) the VUP wall thickness [(VUP OD−VUP ID)/2] is in the range of 0.7 mm–1.5 mm.

Thus we have found that the following approximations of PCA arc tube and feedthrough characteristics define design spaces in which the desired lamp power may be selected from the parameters and vice versa:

TABLE I

| Power W | IL mm | ID mm | IL/ID Aspect Ratio, mm | Wall Loading $W/cm^2$ | Wall Thickness mm | Rod Diameter mm | Rod Length mm |
|---|---|---|---|---|---|---|---|
| 150 | 26–32 | 5–7 | 3.3–6.2 | 20–35 | 0.8–1.1 | 0.4–0.6 | 3–6 |
| 200 | 27–32 | 6.5–7.5 | 3.3–6.2 | 25–30 | 0.85–1.2 | 0.4–0.6 | 4–8 |
| 250 | 28–34 | 7.5–8.5 | 3.3–6.2 | 25–35 | 0.9–1.3 | 0.7–1.0 | 6–10 |
| 300 | 30–36 | 8–9 | 3.3–6.2 | 25–37 | 0.92–1.4 | 0.7–1.0 | 6–10 |
| 350 | 33–40 | 8.5–10 | 3.3–6.2 | 24–40 | 0.98–1.48 | 0.7–1.1 | 6–11 |
| 400 | 36–45 | 8.5–11 | 3.3–6.2 | 22–40 | 1.0–1.5 | 0.7–1.1 | 6–11 |

Preferably also (1) the tip extension of the electrode is in the range of 0.2–1.0 mm, (2) the tip-to-bottom (ttb) distance, ie. the length of electrode inside the arc tube body, is in a range of 1 mm to 4 mm and generally increases with power, (3) cermet should contain no less then about 35 wt. % Mo, with a preferred Mo content of no less than about 55 wt. % with the remainder being $Al_2O_3$, (4) the frit (also known as sealing ceramic) flow should completely cover the Nb rod, and (5) the VUP wall thickness [(VUP OD−VUP ID)/2] is in the range of 0.7 mm–1.5 mm.

Composition of Metal Halide Salt Mixture

The salt mixture is specially designed for the power range and arc tube geometry used for this product family. The following table gives the nominal composition of the salt mixture wherein the total composition is 100%:

TABLE II

| Salt | NaI | TlI | $CaI_2$ | $DyI_3$ | $HoI_3$ | $TmI_3$ |
|---|---|---|---|---|---|---|
| Wt. % | 6–25 | 5–6 | 34–37 | 11–18 | 11–18 | 11–18 |

The filling of the discharge vessel includes about 1–5 mg Hg. The mercury content is similar to that of Philips' Alto Plus lamps, i.e. about <5 mg and the lamps of the invention have passed the TCLP test and thus are environmentally friendly. In addition, the lamps also contain about 10–50 mg metal halide in a ratio of 6–25 wt % mol NaI, 5–6 wt % TlI, 34–37 wt % $CaI_2$, 11–18 wt % $DyI_3$, 11–18 wt % $HoI_3$, and 11–18 wt % $TmI_3$.

Buffer Gas Composition and Pressure Range

The arc tube is also filled with a mixture of noble gases for assisting lamp ignition. The composition of the gas is a minimum of about 99.99% of Xenon and a trace amount of $^{85}Kr$ radioactive gas but may use Ne, Ar, Kr, or a mixture of rare gases instead of pure Xe as possible alternatives. Pure xenon is preferred since the lamp efficacy has been indicated to be higher when compared to lamps with Ar. Additionally, the breakdown voltage of lamps utilizing xenon is higher than that of lamps with Ar, and the wall temperature of lamps is lower than that of lamps with Ar. The room temperature fill pressure of this product family is preferably in a range of about 50 torr to about 150 torr.

Molybdenum Coil

As discussed above, for reducing the risk of non-passive failure, a molybdenum coil wrapped around the arc tube and around the extended plugs is used. Preferably, a Mo coil antenna wrapped around a PCA arc tube and around at least a portion of the extended plugs is used. The coil antenna serves as an antenna for starting or ignition, provides good capacitive coupling for ignition, has no adverse effect on the efficacy or lifetime properties of the lamps, and also provides mechanical containment of particles in the event of arc tube rupture.

The product family will have a wide range of usage in both indoor and outdoor lighting applications. The primary indoor applications include constantly-occupied large-area warehouse or retail buildings requiring high color rendering index, high visibility and low lamp-to-lamp color variation. Outdoor applications include city street lighting, building and structure illumination and highway lighting.

It will be understood that the invention may be embodied in other specific forms without departing from the spirit and scope or essential characteristics thereof, the present disclosed examples being only preferred embodiments thereof.

We claim:

1. A metal halide discharge lamp comprising a ceramic discharge vessel enclosing a discharge space, said discharge vessel including within said discharge space an ionizable material comprising a metal halide, a first and second discharge electrode feedthrough means, and a first and second current conductor connected to said first and second discharge electrode feedthrough means, respectively;

said lamp having a molybdenum coil wrapped around the discharge vessel and at least a portion of the electrode feed through means, and having a power range of about 150 W to about 1000 W and exhibiting one or more of a characteristic selected from the group consisting of a CCT (correlated color temperature) of about 3800 to about 4500K, a CRI (color rendering index) of about 70 to about 95, a MPCD (mean perceptible color difference) of about ±10, and a luminous efficacy up to about 85–95 lumens/watt.

2. A lamp as claimed in claim 1 retrofit with ballasts designed for high pressure sodium or quartz metal halide lamps.

3. A discharge lamp having a power range of about 150 W to about 1000 W and comprising a ceramic discharge vessel enclosing a discharge space, said discharge vessel including within said discharge space an ionizable material comprising a metal halide, a first and second discharge electrode feedthrough means, and a first and second current conductor connected to said first and second discharge electrode feedthrough means, respectively;

wherein the ceramic discharge vessel includes an arc tube comprising:

a cylindrical barrel having a central axis and a pair of opposed end walls, a pair of ceramic end plugs extending from respective end walls along said axis, a pair of lead-ins extending through respective end plugs, said lead-ins being connected to respective electrodes which are spaced apart in said central barrel, wherein the electrode feedthrough means each have a lead-in of niobium which is hermetically sealed into the arc tube, a central portion of molybdenum/aluminum cermet, a molybdenum rod portion and a tungsten tip having a winding of tungsten, and wherein said lamp has a molybdenum coil attached to the arc tube and at least a portion of the ceramic end plugs.

4. A lamp as claimed in claim 3, wherein the arc tube has a molybdenum coil wrapped around a substantial portion and around at least a portion of the ceramic end plugs.

5. A lamp as claimed in claim 4, wherein the discharge space contains an ionizable filling of an inert gas, a metal halide, and mercury.

6. A lamp as claimed in claim 5 wherein, said discharge vessel has a ceramic wall and is closed by a ceramic plug, said electrode feedthrough means including at least one tungsten electrode which is connected to a niobium electric current conductor by means of a leadthrough element which projects into the ceramic plug with a tight fit, is connected thereto in a gastight manner by means of a sealing ceramic and has a part formed from aluminum and molybdenum which forms a cermet at the area of the gastight connection.

7. A lamp as claimed in claim 5, wherein said discharge vessel has a ceramic wall and is closed by a ceramic plug, said electrode feedthrough means including at least one tungsten electrode which is connected to a niobium electric current conductor by means of a leadthrough element which projects into the ceramic plug with a tight fit, is connected thereto in a gastight manner by means of a sealing ceramic and has a first part formed from aluminum and molybdenum which forms a cermet at the area of the gastight connection and a second part which is a metal part and extends from the cermet in the direction of the electrode.

8. A lamp as claimed in claim 7, wherein the metal part is a molybdenum rod.

9. A lamp as claimed in claim 5, wherein the arc tube has an aspect ratio (IL/ID) in the range of about 3.3 to about 6.2.

10. A lamp as claimed in claim 6 or 7, wherein the electrode has a tip extension in the range of about 0.2 to about 0.5 mm; the cermet contains at least about 35 wt. % Mo with the remainder being $Al_2O_3$, and the as sealing ceramic flow completely covers the Nb connector.

11. A lamp as claimed in claim 10, wherein the arc tube and the electrode feedthrough means have the following characteristics for a given lamp power:

| Power W | IL mm | ID mm | IL/ID aspect ratio, mm | Wall Loading W/cm$^2$ | Wall Thickness mm | Rod Diameter mm | Rod Length mm |
|---|---|---|---|---|---|---|---|
| 150 | 26–32 | 5–7 | 3.3–6.2 | 20–35 | 0.8–1.1 | 0.4–0.6 | 3–6 |
| 200 | 27–32 | 6.5–7.5 | 3.3–6.2 | 25–30 | 0.85–1.2 | 0.4–0.6 | 4–8 |

-continued

| Power W | IL mm | ID mm | IL/ID aspect ratio, mm | Wall Loading W/cm$^2$ | Wall Thickness mm | Rod Diameter mm | Rod Length mm |
|---|---|---|---|---|---|---|---|
| 250 | 28–34 | 7.5–8.5 | 3.3–6.2 | 25–35 | 0.9–1.3 | 0.7–1.0 | 6–10 |
| 300 | 30–36 | 8–9 | 3.3–6.2 | 25–37 | 0.92–1.4 | 0.7–1.0 | 6–10 |
| 350 | 33–40 | 8.5–10 | 3.3–6.2 | 24–40 | 0.98–1.48 | 0.7–1.1 | 6–11 |
| 400 | 36–45 | 8.5–11 | 3.3–6.2 | 22–40 | 1.0–1.5 | 0.7–1.1 | 6–11. |

12. A lamp as claimed in claim 11, wherein said metal halide comprises the following salts of 6–25 wt % NaI, 5–6 wt % TlI, 34–37 wt % $CaI_2$, 11–18 wt % $DyI_3$, 11–18 wt % $HoI_3$, and 11–18 wt % $TmI_3$.

13. A lamp as claimed in claim 12, wherein the ionizable filling is a mixture of about 99.99% of Xenon and a trace amount of Kr-85 radioactive gas.

14. A lamp as claimed in claim 12, wherein the ionizable filling is a one or more rare gases, such as Neon, Argon, Krypton and Xenon.

15. A lamp as claimed in claim 12, wherein the ionizable filling is Xenon.

16. A lamp as claimed in claims 1 or 5, having a power range of about 150 W to about 1000 W and 100V to 263V, and one or more of the following characteristics: a lumen maintenance of >80%, a color temperature shift <200K from 100 to 10,000 hours, and lifetime of about 10,000 to about 25,000 hours.

* * * * *